US006012448A

United States Patent [19]

Arsenault

[11] Patent Number: 6,012,448

[45] Date of Patent: Jan. 11, 2000

[54] FIREPLACE DRAFT REGULATOR

[76] Inventor: John W. Arsenault, P. O. Box 1837, Edgartown, Mass. 02539

[21] Appl. No.: 09/033,165

[22] Filed: Mar. 2, 1998

[51] Int. Cl.[7] ..... F24B 1/18

[52] U.S. Cl. ..... 126/500; 126/539; 126/544; 126/307 A

[58] Field of Search ..... 126/500, 549, 126/544, 547, 550, 290, 285 R, 545, 307 A, 539, 536, 523, 533; 454/359, 358; 110/315

[56] References Cited

U.S. PATENT DOCUMENTS

| | | | |
|---|---|---|---|
| 485,772 | 11/1892 | Peel | 126/500 |
| 3,765,399 | 10/1973 | Gerlach | 126/550 |
| 3,802,415 | 4/1974 | Richard | 126/538 |
| 3,965,886 | 6/1976 | Nelson | 126/549 |
| 3,995,611 | 12/1976 | Nelson | 126/521 |
| 4,019,491 | 4/1977 | DiRocco | 126/500 |
| 4,574,773 | 3/1986 | Moughamian | 126/549 |
| 5,575,274 | 11/1996 | DePalma | 126/285 R |

*Primary Examiner*—Ira S. Lazarus
*Assistant Examiner*—Josiah C. Cocks
*Attorney, Agent, or Firm*—William Nitkin

[57] ABSTRACT

A fireplace downdraft regulator having a first end and a second end, such regulator extending across the top of a fireplace opening, such regulator having an aerodynamic draft header portion having a front face and a height and length, such draft header portion extending downwardly and rearwardly from the fireplace top at approximately 45 degrees to a vertical to form a corner angle and then extending upwards at approximately 90 degrees to the aerodynamic draft header portion to form a deflector portion with the deflector portion angled upwards into the chimney such that the inside portion of the regulator deflects downdrafts back upwards within the chimney and the aerodynamic draft header portion aids in drawing air from the room, which air travels down its front face and around the corner angle and back up the outside face of the deflector portion to help increase the updraft of air within the chimney.

7 Claims, 4 Drawing Sheets

FIREPLACE DRAFT REGULATOR

BACKGROUND OF THE INVENTION

1. Field of the Invention

This invention resides in the area of fireplaces and chimneys and more particularly relates to a device that directs an air flow in fireplaces and also acts to reduce downdrafts and increase the draft in the fireplace chimney.

2. Description of the Prior Art

Some fireplace chimneys of the prior art incorporate angled plates which extend in the chimney upwards in the flue to help reduce downdrafts. Downdrafts cause air from the chimney to go into the fireplace, interfering with combustion and causing smoke to pass into the surrounding room. Typically, some air of a downdrafts in the chimney is deflected by such angled plate(s) and diverted from entering the fireplace area. However, such designs are not completely successful in preventing downdrafts, as the plates do not effectively block all air flow coming down the chimney. U.S. Pat. No. 4,019,491 to DiRocco teaches a massive chimney throat structure with an arc-shaped air shelf for drawing downdrafts into a diversion chamber, but such assembly is not easily retrofitted to an existing fireplace. The DiRocco structure is positioned completely above the fireplace area and does not extend into the combustion area, and thus does not act to help draw air from the surrounding room.

SUMMARY OF THE INVENTION

The present invention prevents downdrafts by providing an angled downdraft regulator which both blocks the flow of much of the downdraft from the chimney and also stimulates the flow of air into the fireplace from the surrounding room. The regulator of this invention is easily installed in existing fireplaces by bolts passed through each side of the device into the sides of the fireplace, and the device can be provided in sizes to fit a variety of fireplace opening dimensions.

When installed, the front face of the regulator forms an aerodynamic draft header which is angled downward at approximately a 45 degree angle from a vertical line from the top opening of the fireplace. The aerodynamic shape of the header helps produce a flow of air from the room into the fireplace. This air combines with the heated smoky air inside the fireplace, and the combined air curves around to the back side of the regulator which back side is disposed at approximately a 90 degree angle to the front face. The room air contributes to the air flow around the front face of the regulator, which due to its aerodynamic shape, aids in directing the combined room air and smoky air up the chimney.

The back side of the regulator also acts as a deflector plate which prevents a substantial amount of downdraft from proceeding down the chimney into the fireplace. Any downdrafts which successfully go around the deflector encounter the enhanced upwards air flow resulting from the room air drafting around the header, as previously discussed. Thus, this device effectively prevents downdrafts in the chimney from driving, smoke into the room and increases the updraft in the chimney.

It is an object of this invention to provide a means to prevent downdrafts from bringing air from the chimney and smoky air produced by combustion into the room in which the fireplace is located and to increase the updraft in the chimney.

It is a further object of this invention to provide such a device which can be easily installed in existing fireplaces.

It is yet a further object of this invention to provide a device which does not interfere with the aesthetic appearance of a fireplace.

DESCRIPTION OF THE PREFERRED EMBODIMENT(S)

Figure 1:
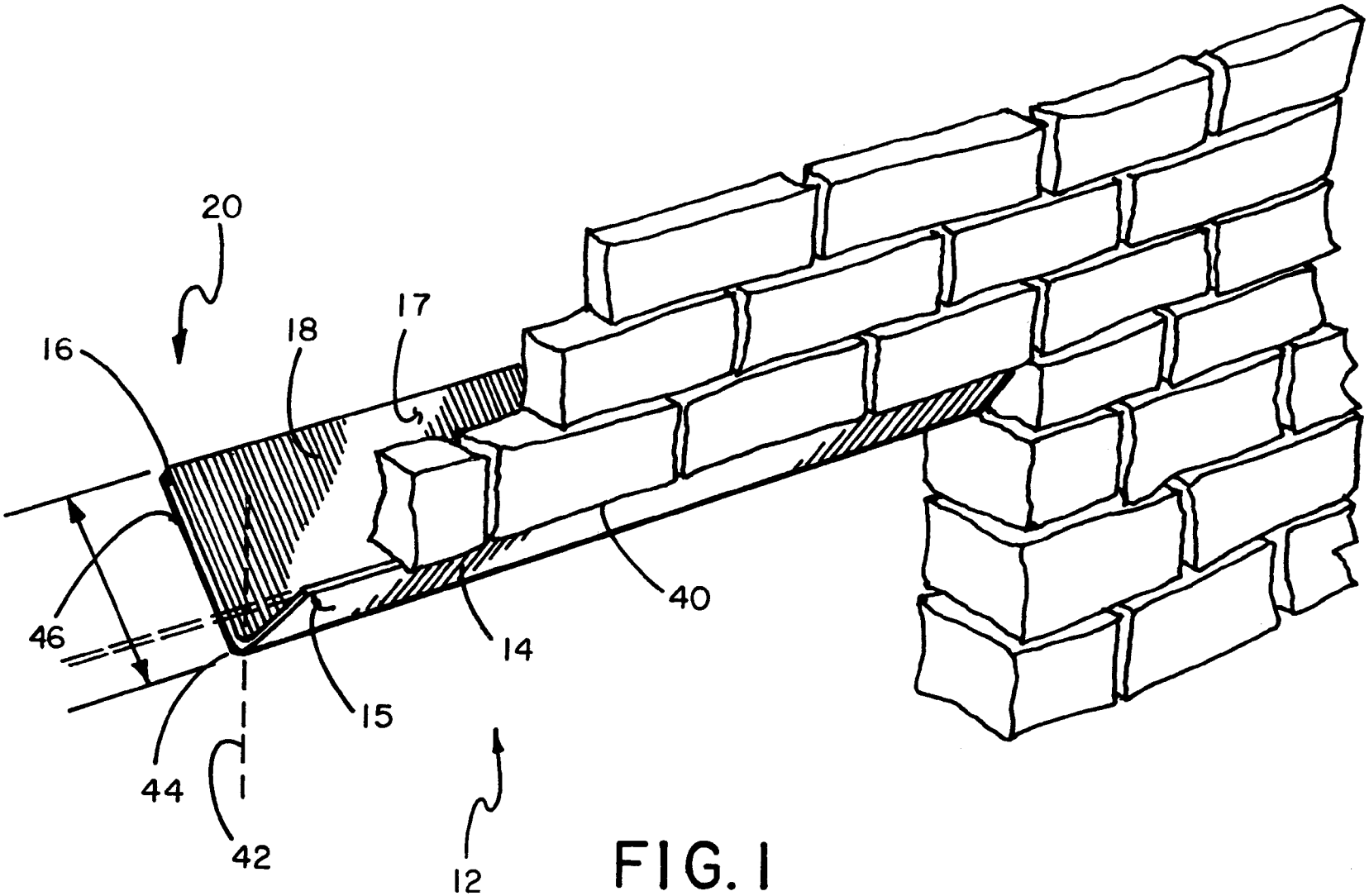
FIG. 1 illustrates a perspective front view of a portion of the downdraft regulator of this invention installed in a fireplace with a portion of the fireplace shown in cutaway form.

FIG. 1 illustrates a view of downdraft regulator 20 of this invention installed in a fireplace made of bricks 10 which form fireplace opening 12. Downdraft regulator 20 can be made from a planar piece of fire-resistant material such as metal bent to form a substantially L-shape in cross-section consisting of two planar portions: downdraft deflector 18 and aerodynamic draft header 14, the two portions in a preferred embodiment being disposed at an angle of approximately 90 degrees to each other. Downdraft deflector 18 extends upwards at an angle of approximately 45 degrees to vertical plane 42 and its height is approximately twice the height of aerodynamic draft header 14. In a preferred embodiment the height of the downdraft deflector is approximately 10 inches, and the height of the draft header is approximately 5 inches. Air traveling down the chimney creates a downdraft which is substantially deflected upwards by the inside face 17 of draft deflector 18, preventing much of the cold chimney air from interfering with combustion in the fireplace and entering the surrounding room. Aerodynamic draft header 14 is angled at approximately 45 degrees to vertical plane 42 and is positioned directly below top 40, extending downward about 2.5 inches within fireplace opening 12. Draft header 14 is angled to produce an aerodynamic flow of air from the surrounding room, which air enters fireplace opening 12. The air flow initially is drawn into the updraft of the fire, causing an increase air flow movement which is first directed down the front face 15 of draft header 14, around 90-degree angle 44 and up outside face 16 of deflector 18 toward the chimney. This room air draft has the effect of substantially counteracting any downdrafts which successfully avoid deflector 18 and travel into the fireplace. The overall effect is to reduce any downdrafts from passing down the chimney into the surrounding room.

Figure 2:
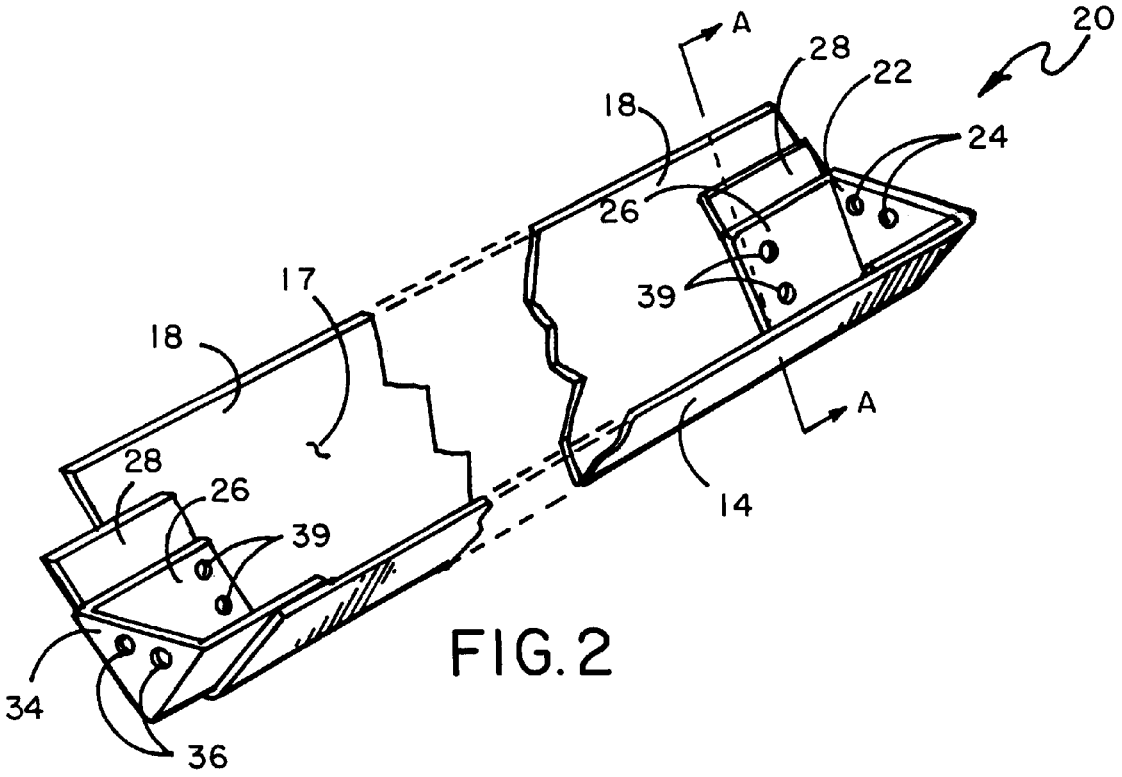
FIG. 2 illustrates a perspective front view of the device with its midportion cut away.

FIG. 2 illustrates downdraft regulator 20 with its central section cut away. Seen in this view is first and second brackets 22 and 34 with first and second sets of holes 24 and 36, respectively, for attachment to inner sides 41 and 43 of the fireplace opening as seen in FIG. 6.

Figure 3:
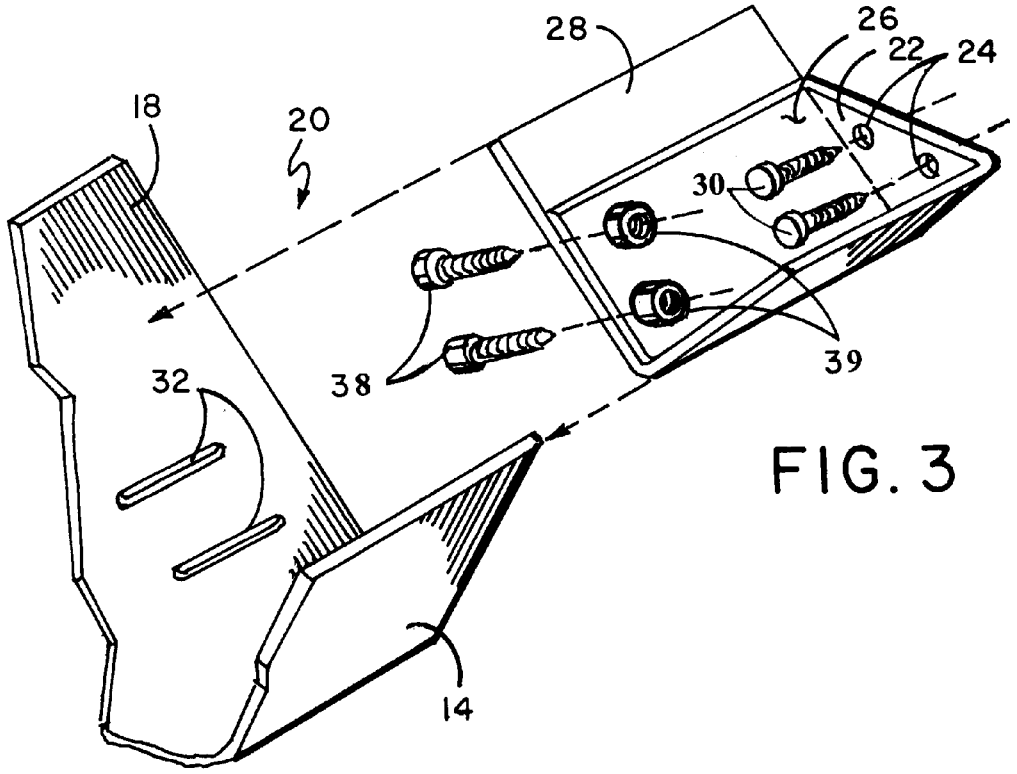
FIG. 3 illustrates an exploded view of one end of the device, showing the attachment of the bracket.
Figure 4:
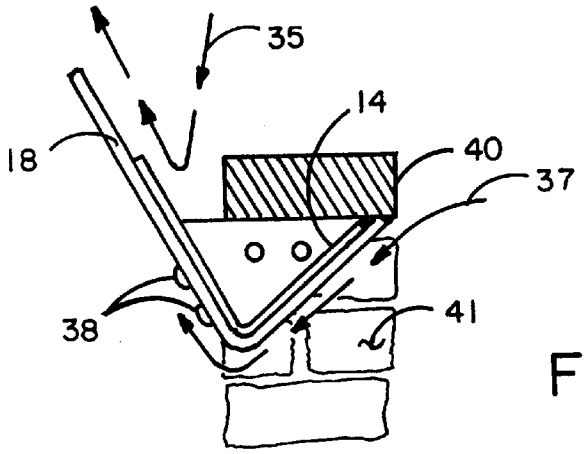
FIG. 4 illustrates a cross-sectional side view through A—A of FIG. 2 of the bolt attachment of the support.
Figure 5:
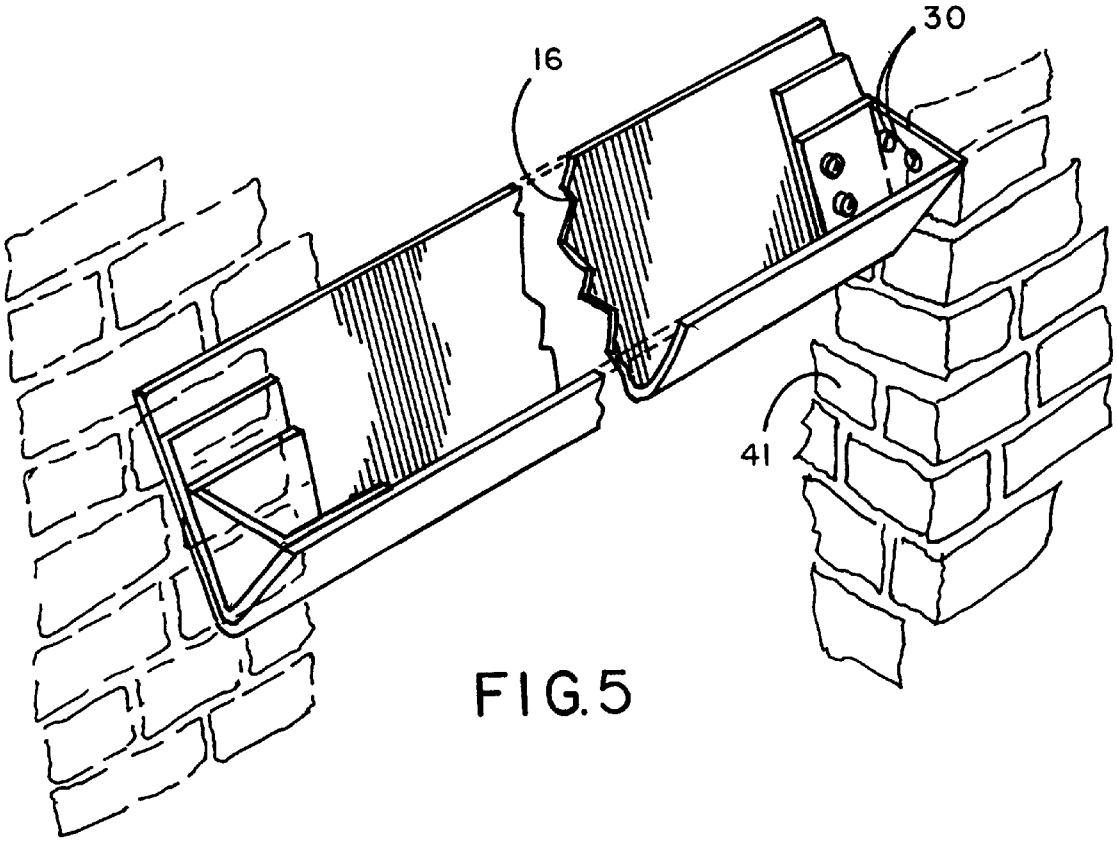
FIG. 5 illustrates a perspective view of the attachment of the device at one end to a fireplace.

FIG. 3 illustrates the first end of regulator 20 showing first bracket 22 of regulator 20 having first set of holes 24 which first bracket can be formed of a single piece with first side bracket support 26 folded around and attached to regulator support 28. As seen in FIG. 3, regulator 20 is bolted onto regulator support 28 through elongated slots 32 which allow for horizontal adjustment and centering of regulator 20. Regulator support 28 can have two bolt receipt members 39 which align with elongated slots 32 defined in regulator 20. Bolts 38, as seen in FIG. 4, pass through elongated slots 32 into bolt receipt members 39 to connect regulator 20 to regulator support 28. Similar bolts also attach bracket 34 to the second end of regulator 20 in a similar fashion. Bolts 30 extend through holes 24 and 36 to attach brackets 22 and 34, respectively, to the first and second sides 41 and 43 of fireplace 45 as seen in FIG. 6. Other means of attachment of the device to the fireplace can also be utilized.

In a preferred embodiment downdraft regulator 20 can be whatever length is necessary to fit across the top of the opening of any given fireplace. Draft header 14, as shown in FIGS. 1 and 4, protrudes downward approximately 2.5 inches into fireplace opening 12. Downdraft deflector 18 can be about ten inches in height, or approximately twice the height of draft header 14. Downdraft deflector 18 and draft header 14 are angled at approximately 90 degrees to one another, with the radius of the bend being approximately one inch. FIG. 4 shows air flow 37 passing down and around draft header 14 as well as downdraft 35 striking and being deflected back up the chimney. The size of the downdraft regulator of this invention can be adjusted up to approximately 40%, while maintaining the approximate size and angle proportions of the respective components yet still functioning as described. The thickness of the regulator is not fixed, and other types of noncombustible materials besides metals can be used in its manufacture.

Figure 6:
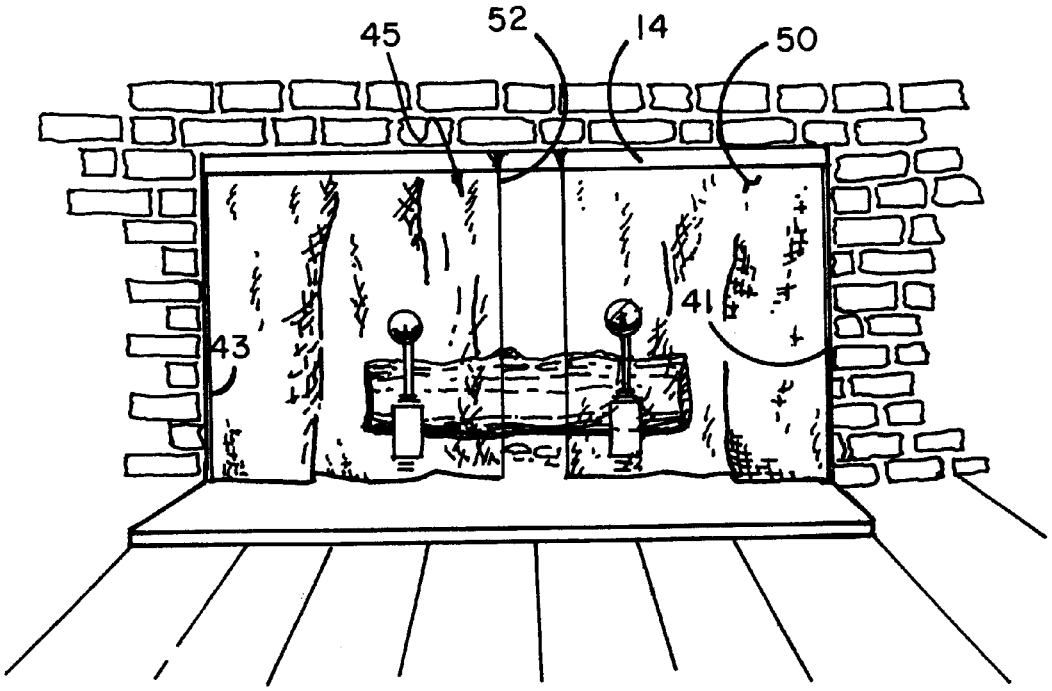
FIG. 6 illustrates a front view of a fireplace with a fire curtain attached to the downdraft regulator of this invention.

FIG. 6 illustrates a front view of fireplace 45 showing fire curtain 50 attached to the top front of draft header 14. The curtain can open, such as at area 52, and can be attached by a variety of ways, such as by being suspended from a rod attached to draft header 14. Other equivalent means of attachment can be utilized to provide a fire curtain that can be opened to provide access into the fireplace and closed to prevent sparks from coming out of the fireplace.

Although the present invention has been described with reference to particular embodiments, it will be apparent to those skilled in the art that variations and modifications can be substituted therefor without departing from the principles and spirit of the invention.

I claim:

1. A device for installation in a masonry fireplace of a room, said fireplace having an opening defined therein, said opening having first and second side ends defining a length therebetween, said fireplace opening extending to a chimney, said devied comprising:

a regulator having a first end and a second end, said regulator extending across said top of said fireplace opening in said masonry fireplace, said regulator having an aerodynamic draft header portion having a front face, a height and a length, said draft header extending downwardly and rearwardly from said fireplace top at approximately 45 degrees to a vertical forming a corner angle and then extending upwards at approximately 90 degrees to said aerodynamic draft header portion to form a deflector portion having an inside face portion and an outside face portion, a height and a length, said deflector portion angled upwards into said chimney with said inside face portion of said regulator deflecting downdrafts upwards within said chimney and said aerodynamic draft header portion aiding in drawing air from said room down its front face and around said corner angle and back up said outside face of said deflector portion to increase the updraft of air within said chimney.

2. The device of claim 1 further including means to attach said regulator to said fireplace.

3. The device of claim 1 further including means to attach said first and second ends of said regulator to said fireplace.

4. The device of claim 1 wherein said height of said deflector portion is approximately twice the height of said draft header portion.

5. The device of claim 4 wherein said deflector portion is approximately 10 inches in height and is angled at approximately 45 degrees to a vertical plane and said draft header portion is approximately 5 inches high and positioned approximately 90 degrees to said deflector portion, said draft header being angled at approximately 45 degrees to a vertical plane.

6. The device of claim 5 wherein said regulator is made of metal.

7. A method for reducing downdrafts of air in a masonry fireplace in a room, said fireplace having a chimney, a top and first and second side ends defining the length of said fireplace, comprising the steps of:

providing an L-shaped fire-resistant planar member having two legs, one longer than the other, forming a downdraft deflector portion formed by said longer leg of said L-shaped planar member and a draft header portion formed by said shorter leg of said L-shaped planar member, said downdraft deflector portion having an inner side and an outer side and said draft header portion having a front face;

disposing said draft header portion to protrude downward from said top of said fireplace opening along said length of said fireplace, said draft header portion angled at approximately 45 degrees to a vertical plane;

disposing said downdraft deflector portion at approximately 45 degrees to a vertical plane and at approximately 90 degrees to said draft header portion;

directing downdrafts striking said inner side of said downdraft deflector back up said chimney; and directing any room air striking said draft header portion down its front face, around said approximate 90 degree angle, up said outer side of said downdraft deflector and up said chimney.

* * * * *